US006086521A

United States Patent [19]

Solland

[11] Patent Number: 6,086,521

[45] Date of Patent: Jul. 11, 2000

[54] EXERCISE DEVICE

[76] Inventor: Kurt Solland, 419 E. 5th St. Apt. F, Long Beach, Calif. 90802

[21] Appl. No.: 09/173,427

[22] Filed: Oct. 15, 1998

Related U.S. Application Data

[60] Provisional application No. 60/062,270, Oct. 17, 1997.

[51] Int. Cl.[7] ..... A63B 26/00

[52] U.S. Cl. ..... 482/140; 482/72; 482/96

[58] Field of Search ..... 482/140, 96, 72, 482/91, 148; D12/6; 280/16, 18

[56] References Cited

U.S. PATENT DOCUMENTS

| | | | |
|---|---|---|---|
| 3,904,196 | 9/1975 | Berlin | 272/72 |
| 4,452,448 | 6/1984 | Ausherman | 272/131 |
| 5,346,447 | 9/1994 | Stearns | 482/96 |
| 5,370,594 | 12/1994 | Grinblat | 482/72 |
| 5,569,130 | 10/1996 | Wang et al. | 482/96 |
| 5,575,741 | 11/1996 | Fan | 482/72 |
| 5,795,271 | 8/1998 | Pearson | 482/72 |

*Primary Examiner*—Richard J. Apley
*Assistant Examiner*—Lori Baker
*Attorney, Agent, or Firm*—Westman, Champlin & Kelly, P.A.

[57] ABSTRACT

An exercise device is provided, which is of simple and inexpensive construction, compact, lightweight, and portable, and allows the user to use his or her own weight to create a form of resistance in performing a variety of exercise routines directed to different muscle groups of the body. The exercise device is comprised of a support platform that carries the user and is pivotally connected to an upper location of a base frame that rests on a flat surface, a lifting bar that is pivotally attached to the base frame, a carrier bar that is adjustably attached to the lifting bar and is also pivotally attached to a lower location of the support platform, wherein upon raising of the lifting bar, the carrier bar is raised, which in turn causes the support platform carrying the user thereon to pivot about its connection to the base frame and be raised. In this manner, the exercise device utilizes the weight of the user as a counterweight resistance to the raising of the lifting arm.

15 Claims, 3 Drawing Sheets

EXERCISE DEVICE

CROSS REFERENCE TO RELATED APPLICATION

The present invention claims priority to provisional application serial No. 60/062,270, filed Oct. 17, 1997, and entitled EXERCISE DEVICE under the provisions of Title 35 U.S. Code § 119(e).

BACKGROUND OF THE INVENTION

This invention generally relates to exercise equipment, and more particularly to an exercise device that is lightweight, portable, inexpensive and easy to use that enables the user to perform a variety of beneficial exercises while utilizing his or her own body mass to act as a counter weight during the exercise routines.

Today's health conscious society utilizes many different types of exercise devices, both for home use and for use in health and exercise clubs, that allow for one or more muscle groups to be exercised. However, many existing exercise devices have certain generally undesirable limiting characteristics: e.g., they are often expensive, large, bulky, heavy, not easily portable or storable, require weights or other mechanisms to provide resistance, are of complicated design and construction, require sophisticated and expensive mechanical and/or electronic systems, and are capable of performing only a very limited number of exercise routines for a very limited number of muscle groups.

The present invention overcomes these problems and disadvantages by providing an exercise device that is of simple but sturdy construction, requires few parts, relatively inexpensive, lightweight, compact, easy to store during non-use, easily portable without the need for reassembly, and capable of performing a variety of exercises for many muscle groups.

SUMMARY OF THE INVENTION

In accordance with the invention, and as shown in exemplary FIGS. 1 through 7, the exercise device comprises a lightweight base frame structure that rests on the floor or other flat surface, a lifting bar pivotally connected to the base frame, a horizontal carrier bar adjustably connected to the lifting bar, wherein the carrier bar is in turn pivotally connected at one location to a support platform that supports the weight of the user of the device, and the support platform also is pivotally connected at another location to the base frame. The lifting bar connects to the carrier bar at one of a plurality of different fore-aft positions to adjust the mechanical moment arm and thereby vary the lifting force that is applied by the user on the lifting bar. More specifically, the user positions himself or herself on top of the support platform, and upon moving the lifting bar up and back down, the lifting bar pivots about its connection to the base frame, the carrier bar is also moved up and down, causing the support platform carrying the weight of the user to pivot about the base frame and be raised or lowered. In this manner, the weight of the user acts as a natural counterweight that provides resistance during various exercise routines.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
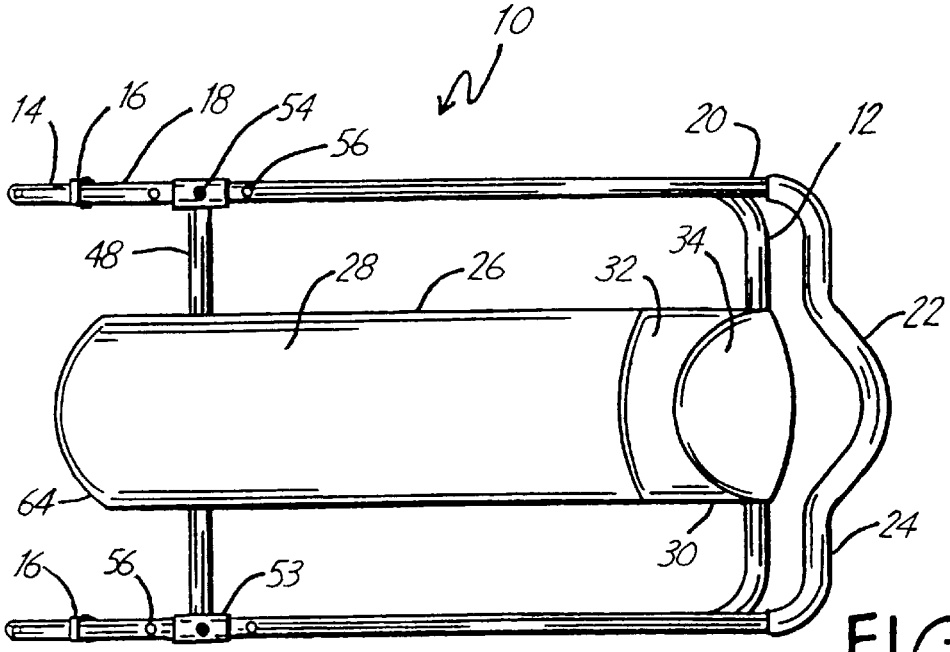
FIG. 1 is a top plan view illustrating an exercise device embodying the present invention.
Figure 2:
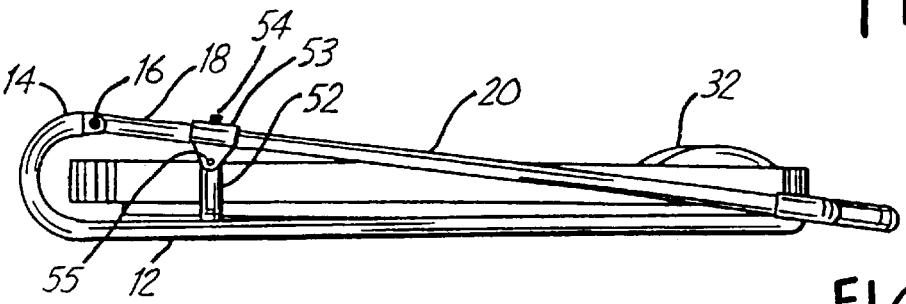
FIG. 2 is a side elevational view illustrating the exercise device of the present invention.

As shown in the exemplary drawings, an exercise device is referred to generally by the reference numeral 10. The exercise device 10 comprises a lightweight but strong base frame 12 having a generally U-shaped structure that rests on the floor or other flat surface. The open ends 14 of the U-shaped base frame 12 curve up where they are pivotally connected by a pair of pivot links 16 formed by a small U-shaped bracket and pin connection to each of two ends 18 of a lifting bar 20. The lifting bar 20 is also generally U-shaped, and its closed end 22 is shaped to allow for varying desirable grip positions and is provided with a padding material 24 to enable an individual using the device to grip the lifting bar with ease and comfort.

The exercise device 10 is provided with a support platform 26 for the user to position himself or herself during the exercise routine. The support platform 26 is constructed of a generally rigid material (e.g., wood, fiberglass, etc.) that does not considerably deform and is capable of maintaining a generally solid shape under the weight of most individuals. The support platform has a padded upper surface 28 to provide general comfort to the user, and the upper surface 28 is also provided at its upper end 30 with a raised neck support section 32 and a head rest section 34 for extra comfort of the user for exercise positions where the user is laying on his or her back. Also, for exercises requiring the user to kneel on the support platform, the upper surface 28 can be provided with a padded knee support section (not shown) for positioning of the knees thereon. The support platform 26 also includes a frame 36 connected to the lower surface 38 of the support platform by way of screws, bolts 39 or other appropriate means. The frame's upper end 40 is pivotally connected to the close end of the U-shaped base frame 12 by a first pair of pivot attachments 42 made of U-shaped bracket and pin connections. Additionally, a second pivot attachment 44 located between the upper end 40 and lower end 46 of the frame 36 connects the frame 36 to a carrier bar 48. Alternatively, while not shown in the drawings, this second pivot attachment 44 can be located at or close to said lower end 46 of the frame.

As illustrated in FIGS. 1–3 and 6–7, the carrier bar 48 is a U-shaped member with a longer intermediate portion 50 and two shorter end portions 52 that curve upward. The two end portions 52 of the carrier bar 48 are connected to the lifting bar 20 by utilizing a pair of collars 53 and removable pins 54 (one at each location), and a plurality of holes 56 located in and near the two ends 18 of the lifting bar 20, with each of the two end portions 52 of the carrier bar having a pivot connection 55 with the lower end 57 of the collar 53 to allow the carrier bar 48 to pivot about the collar 53. Furthermore, by pulling out the pin 54 at each location, the two end portions 52 of the carrier bar 48 can be secured to the lifting bar 20 at a variety of fore and aft positions along the length of the lifting bar.

Figure 3:
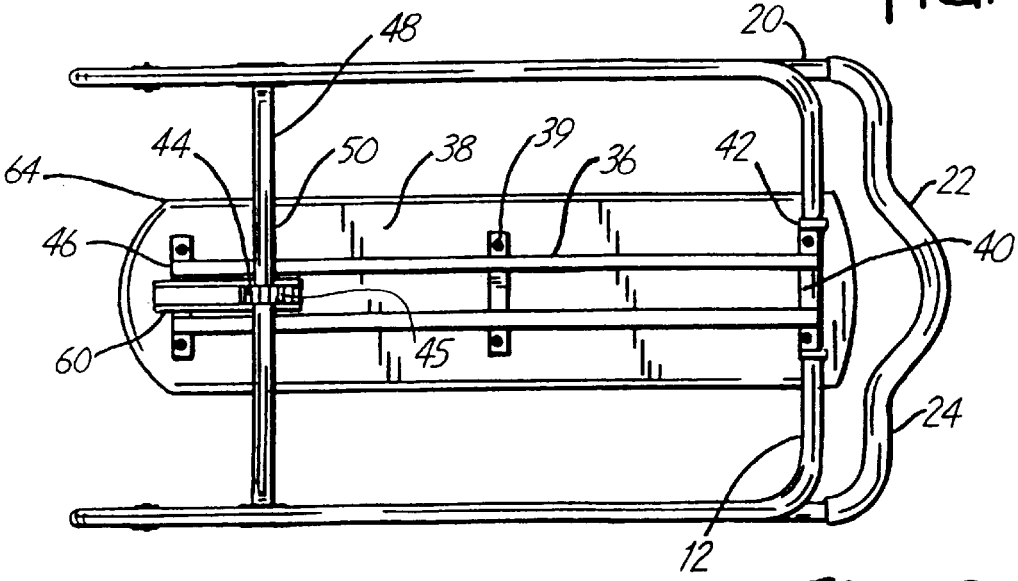
FIG. 3 is a bottom plan view illustrating the exercise device of the present invention.

In addition, as shown in FIG. 3, the longer intermediate portion 50 of the carrier bar assumes a generally horizontal position, and interfaces with the lower surface 38 of the support platform 26 via a slider 45 or a roller mechanism (not shown) moving along a track 60 connected to the frame 36 of the support platform. By way of example, the slider mechanism 45 can be constructed of a T-shaped bracket with the single end of the "T" connected to the carrier bar 48 and the two transverse sections of the "T" engaged within the track. Similarly, instead of a T-shaped slider, a roller wheel can be utilized to travel inside the track 60. In either case, such a slider or roller mechanism would adjust itself fore and aft along the longitudinal axis of the track 60 and the support platform 26 when the exercise device goes through its range of motion.

Figure 4:
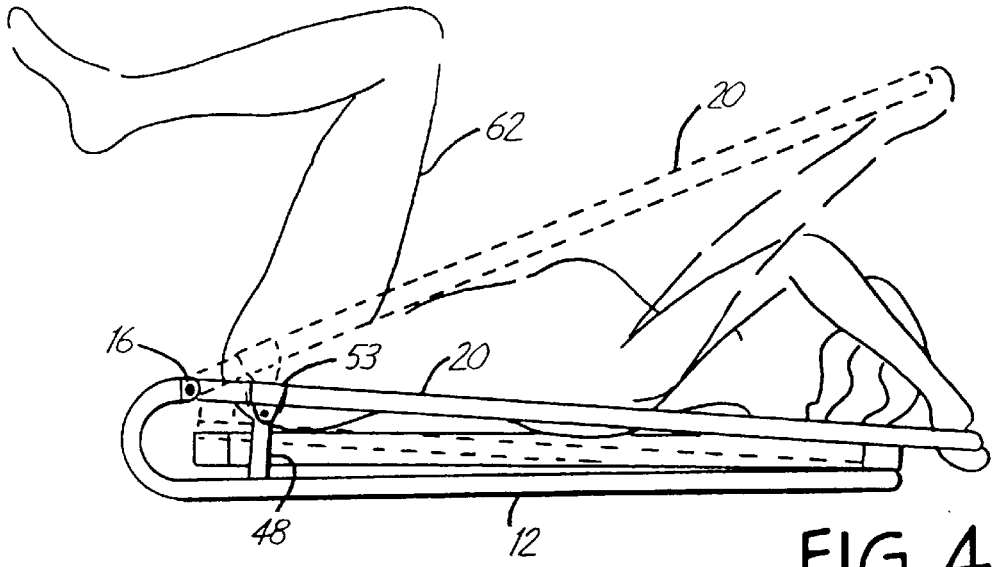
FIG. 4 is a side elevational view similar to FIG. 2, but with an individual user laying with her back on the exercise device and performing an exercise routine, with the lifting bar, the support platform, and the arms of the individual shown by both solid lines and broken lines, with the solid lines reflecting the starting position and the dashed lines reflecting a position where the lifting bar has been raised.

In operation, an individual 62 can utilize the device of the invention to perform various exercise routines and work different muscle groups. For example, as illustrated in FIG. 4, the individual user 62 can lay flat with his or her back on the upper surface 28 of the support platform 26, extend the arms above the shoulders, and grip the padded lifting bar 20 at desired positions. The user then raises the lifting bar 20 (see dashed lines) until the arms reach a desired extended position. In doing so, the lifting bar is raised and pivots about its connections with the base frame 12, and in this process, the raising of the lifting bar 20 also causes the carrier bar 48 to be raised. The raising of the carrier bar 48 then causes the support platform 26 to pivot about its pivoted connection 44 with the carrier bar, which also causes the support platform 26 to pivot about the pair of pivoted attachments 42 to the base frame 12 in an incline position with the lower end 64 of the support platform 26 being lifted upward. In this manner, given that the weight of the user 62 rests on the support platform, the user's own weight acts as a resistance force against the raising of the lifting bar by the user, thus providing for a beneficial exercise routine, especially for the arms, shoulders and other parts of the body.

Figure 5:
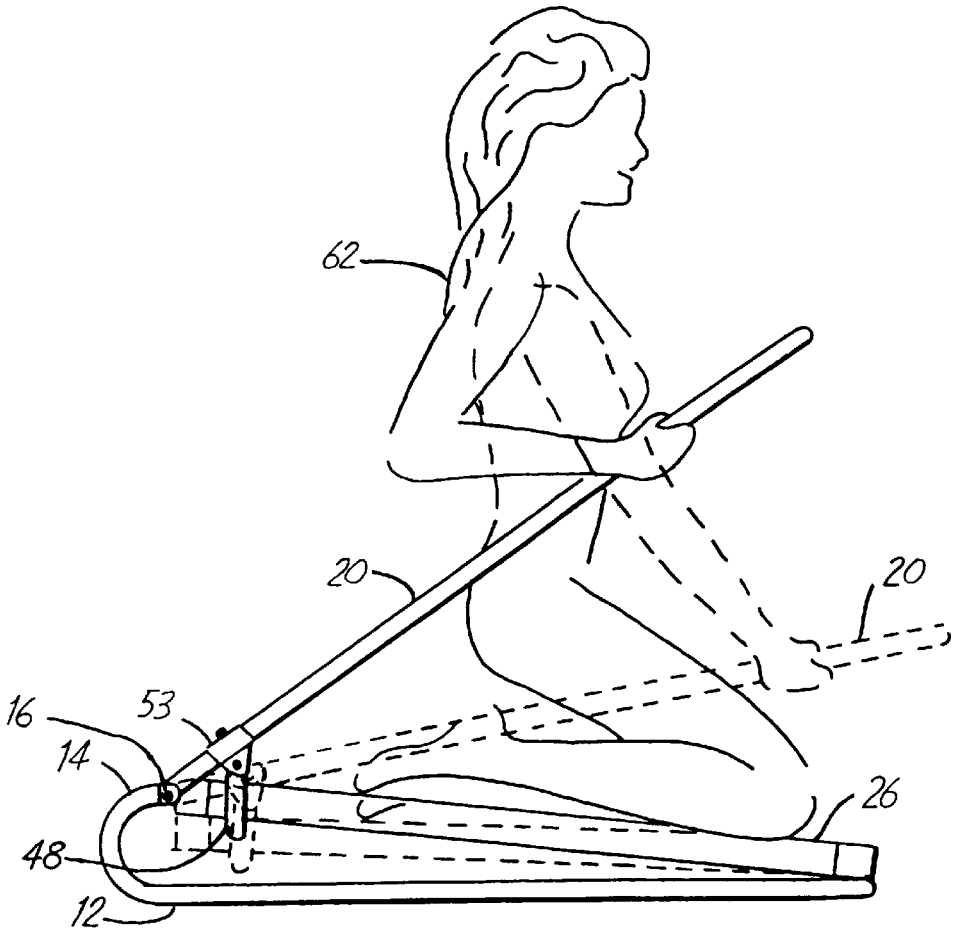
FIG. 5 is a side elevational view similar to FIG. 4, but with an individual user sitting on the exercise device and performing a different exercise routine.
Figure 6:
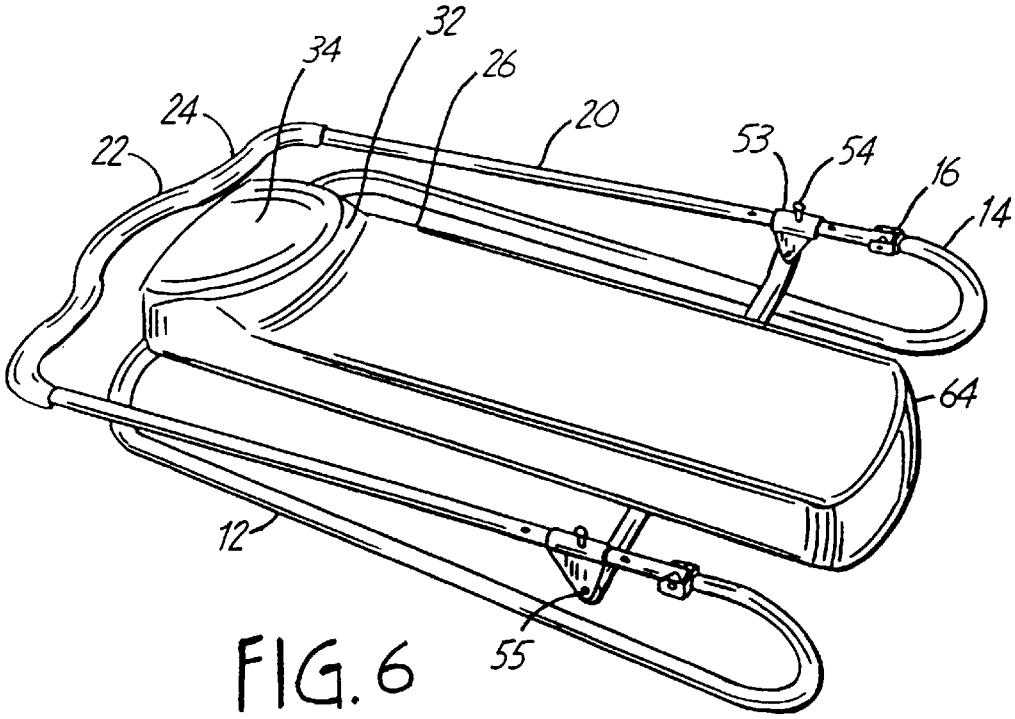
FIG. 6 is a top perspective view of the present invention.
Figure 7:
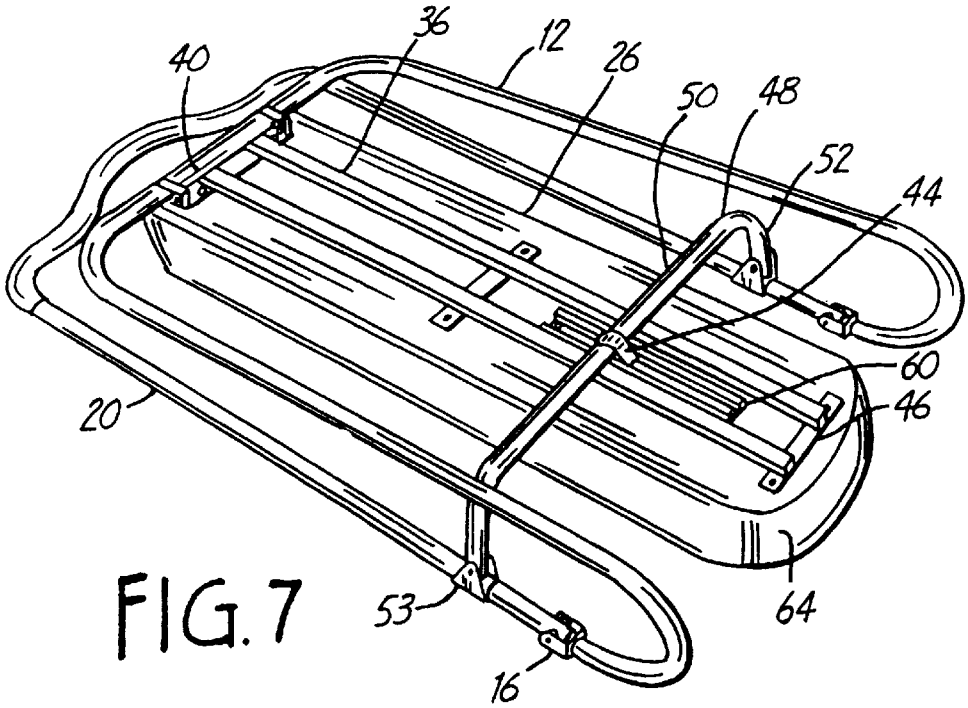
FIG. 7 is a bottom perspective view of the present invention.

In addition to the above exercise position, the user may assume other alternative positions to perform other exercises. For example, in FIG. 5, the user 62 is kneeling on the support platform, and by holding the sides of the lifting bar and raising and lowering it, different shoulder and arm muscles can be emphasized. Furthermore, with reference to FIG. 5, the user can grip the lifting bar at its closed end 22 with the inside of the hands, and by bending movement of the arms from the elbow and raising and lowering the lifting bar, the biceps can be emphasized. Accordingly, by changing the body position and using different grip positions for raising and lowering the lifting arm, other exercises can be performed to concentrate on a variety of muscle groups.

It is understood that a wide variety of modifications to the apparatus of the invention will be apparent to persons skilled in the art without departing from the scope and spirit of the invention. Accordingly, no limitation on the invention is intended by way of the foregoing description and accompanying drawings, except as set forth in the following claims:

What is claimed is:

1. An exercise device comprising:

a base frame for resting said exercise device on a substantially flat surface;

a lifting bar having a first end pivotally connected to said base frame at a first end of the base frame, a second end of said lifting bar moving up and down as the lifting bar is pivoted;

a carrier bar connected to said lifting bar between the first and second ends of the lifting bar; and a support platform for supporting an individual, said support platform being pivotally connected to said base frame substantially at a first location of said support platform spaced from the pivot connection of the lifting bar, and said support platform being pivotally connected to said carrier bar substantially at a second location of said support platform, the second end of the lifting bar being adjacent the support platform and adapted for movement up and down by an individual on the support platform to cause a portion of the support platform to raise and lower about its pivotal connection to the base frame.

2. An exercise device comprising:

a base frame for resting said exercise device on a substantially flat surface;

a lifting bar having a first end pivotally connected to said base frame at a first end of the base frame, a second end of said lifting bar moving up and down as the lifting bar is pivoted;

a carrier bar connected to said lifting bar between the first and second ends of the lifting bar; and a support platform for supporting an individual, said support platform being pivotally connected to said base frame substantially at a first location of said support platform spaced from the pivot connection of the lifting bar, and said support platform being pivotally connected to said carrier bar substantially at a second location of said support platform, and wherein said carrier bar is connected to said lifting bar selectively at one of a plurality of fore and aft positions along said lifting bar.

3. The exercise device of claim 1, wherein said carrier bar is a generally U-shaped member.

4. The exercise device of claim 1, wherein said support platform further includes a means for moving said carrier bar along a longitudinal axis of said support platform.

5. The exercise device of claim 1, wherein said support platform includes a padded upper surface for positioning the individual thereon and a frame connected to a lower side of said support platform.

6. The exercise device of claim 1, wherein said support platform is raised in an incline position.

7. The exercise device of claim 1, wherein the weight of said individual supported on said support platform provides a resistance to the raising of said lifting bar.

8. The exercise device of claim 7, wherein said support platform has a longitudinal axis, and upon raising of said carrier bar, said carrier bar rotates about an axis transverse to said longitudinal axis of said support platform.

9. The exercise device of claim 7, wherein said support platform has a longitudinal axis, and upon raising of said carrier bar, said carrier bar travels along said longitudinal axis of said support platform.

10. The exercise device of claim 1, wherein said first location of said support platform is substantially at a first end of said support platform, and said second location is substantially at a second end of said support platform.

11. The exercise device of claim 1, wherein said first location of said support platform is substantially at a first end of said support platform, and said second location is between said first end and a second end of said support platform.

12. An exercise device comprising:

a base frame for resting said exercise device on a substantially flat surface;

a lifting bar connected to the base frame for raising and lowering movement, relative to the base frame;

a carrier bar connected to said lifting bar spaced from the connection to the base frame, wherein upon raising of said lifting bar, said carrier bar is raised relative to the base frame, and upon lowering of said lifting bar, said carrier bar is lowered relative to the base frame; and a support platform for supporting an individual, said support platform being connected to said base frame at a first location of said support platform, and said support platform being connected to said carrier bar at a second location of said support platform spaced from the first location, wherein upon raising of said lifting bar and said carrier bar, said support platform is raised, and upon lowering of said lifting bar and said carrier bar, said support platform is lowered.

13. The exercise device of claim 12, wherein said first location is substantially at a first end of said support platform, and said second location is substantially at a second end of said support platform.

14. The exercise device of claim 12, wherein said first location is substantially at a first end of said support platform, and said second location is between said first end and a second end of said support platform.

15. The exercise device of claim 12, wherein the weight of said individual supported on said support platform provides a resistance to the raising of said lifting bar.

* * * * *